US005384992A

United States Patent [19]

Roberton

[11] Patent Number: 5,384,992

[45] Date of Patent: Jan. 31, 1995

[54] APPARATUS FOR EXTENDING AN ENCLOSURE

[76] Inventor: Ian Roberton, Merrweather House, Searle Road, Farnham, Surrey, England, GU9 8LJ

[21] Appl. No.: 855,035

[22] PCT Filed: Oct. 5, 1990

[86] PCT No.: PCT/GB90/01531

§ 371 Date: May 6, 1992

§ 102(e) Date: May 6, 1992

[87] PCT Pub. No.: WO91/05117

PCT Pub. Date: Apr. 18, 1991

[30] Foreign Application Priority Data

Oct. 6, 1989 [GB] United Kingdom ..... 8922597

[51] Int. Cl.[6] ..... E04B 1/343

[52] U.S. Cl. ..... 52/67; 160/120; 160/273.1; 109/45

[58] Field of Search ..... 52/67, 68, 69; 109/24.1, 45, 47, 73; 49/127, 143; 292/189, 183, 57; 160/120, 201, 199, 273.1

[56] References Cited

U.S. PATENT DOCUMENTS

| | | | |
|---|---|---|---|
| 1,302,409 | 4/1919 | Murphy | 49/143 |
| 2,937,398 | 5/1960 | Latham | 160/206 |
| 3,137,041 | 6/1964 | Mullen | 52/67 |
| 3,534,512 | 10/1970 | Ballas | 52/67 |
| 4,192,544 | 3/1980 | Patterson | 52/67 |
| 4,411,109 | 10/1983 | Struben et al. | 52/11 |
| 4,428,491 | 1/1984 | Mittelmann et al. | 160/120 |
| 4,557,352 | 12/1985 | Tschappat, Jr. | 52/67 |
| 4,986,037 | 1/1991 | Jackson, Jr. | 52/67 |

FOREIGN PATENT DOCUMENTS

| | | | |
|---|---|---|---|
| 0665853 | 7/1963 | Canada | 52/67 |
| 8800875 | 11/1989 | Netherlands | 52/67 |

*Primary Examiner*—Carl D. Friedman
*Assistant Examiner*—Winnie Yip
*Attorney, Agent, or Firm*—Nixon & Vanderhye

[57] ABSTRACT

Garage extension apparatus comprising a pair of channel section guide tracks, one on each sidewall of the garage, and a movable structure formed of a roof, depending sidewalls and an up-and-over door. The structure is supported on a pair of ground engaging wheels, each mounted at the front of a respective one of the sidewalls by a screw jack, and on a pair of upper wheels which each run in the channel of a respective one of the guide tracks and which are pivotally mounted at the rear of the roof so that the movable structure can follow the slope of the carriageway, up or down, as it is drawn out of the garage. The screw jacks enable the movable structure to be levelled if the ground slopes from one side to the other.

10 Claims, 2 Drawing Sheets

APPARATUS FOR EXTENDING AN ENCLOSURE

BACKGROUND OF THE INVENTION

This invention relates to apparatus for extending an enclosure formed by structure and provided with an opening for access to the enclosure from outside the structure, the enclosure providing protected internal space for domestic, commercial and industrial purposes, eg. garages, workshops etc.

FR-A-2576955, FR-A-1583741 and FR-A-1059516 disclose various forms of apparatus for extending an enclosure temporarily comprising movable structure forming a roof portion and sidewalls depending from the roof portion, the movable structure being guided for substantially rectilinear movement into and out of the enclosure by interengagement of wheels mounted on a sidewall of the enclosure with straight guide tracks in the sidewalls of the movable structure. Problems would arise if ground to be traversed by the movable structure as it is drawn out of the enclosure was not substantially flat and horizontal. In the case of the apparatus disclosed by FR-A-1583741 all the weight of the movable structure would have to be borne by the wheels mounted in the enclosure whereas the telescopic arrangement disclosed by FR-A-2576955, could not allow one of its modules to follow a carriageway which slopes up or down from the front of the enclosure, which is quite common with garages of houses in modern housing estates.

An object of this invention is to provide apparatus for extending an enclosure which is better able to follow the slope of a carriageway in front of the enclosure than the apparatus disclosed in the references discussed above.

SUMMARY OF THE PRESENT INVENTION

According to this invention there is provided apparatus for extending an enclosure temporarily comprising movable structure forming a roof portion and sidewalls depending from the roof portion and a wheel at the bottom of each sidewall for running on the ground as the movable structure is slid into and out of the enclosure, said movable structure being guided for substantially rectilinear movement into and out of the enclosure by interengagement of pivotally mounted means with straight guide track means wherein said guide track means are to be statically mounted on or formed by structure forming the enclosure, and said pivotally mounted means are pivotally mounted on the movable structure at a location thereon relative to the location of said wheels which allows the attitude of the movable structure relative to said guide track means to be adjustable automatically whereby to permit the movable structure to follow the slope of the carriageway as it is drawn out from within the enclosure or pushed back into the enclosure.

Preferred features of the apparatus are defined by the sub-claims.

BRIEF DESCRIPTION OF THE DRAWING FIGURES

One embodiment of this invention will be described now by way of example, with reference to the accompanying drawings, of which:

DESCRIPTION OF A PREFERRED EMBODIMENT

Figure 1:
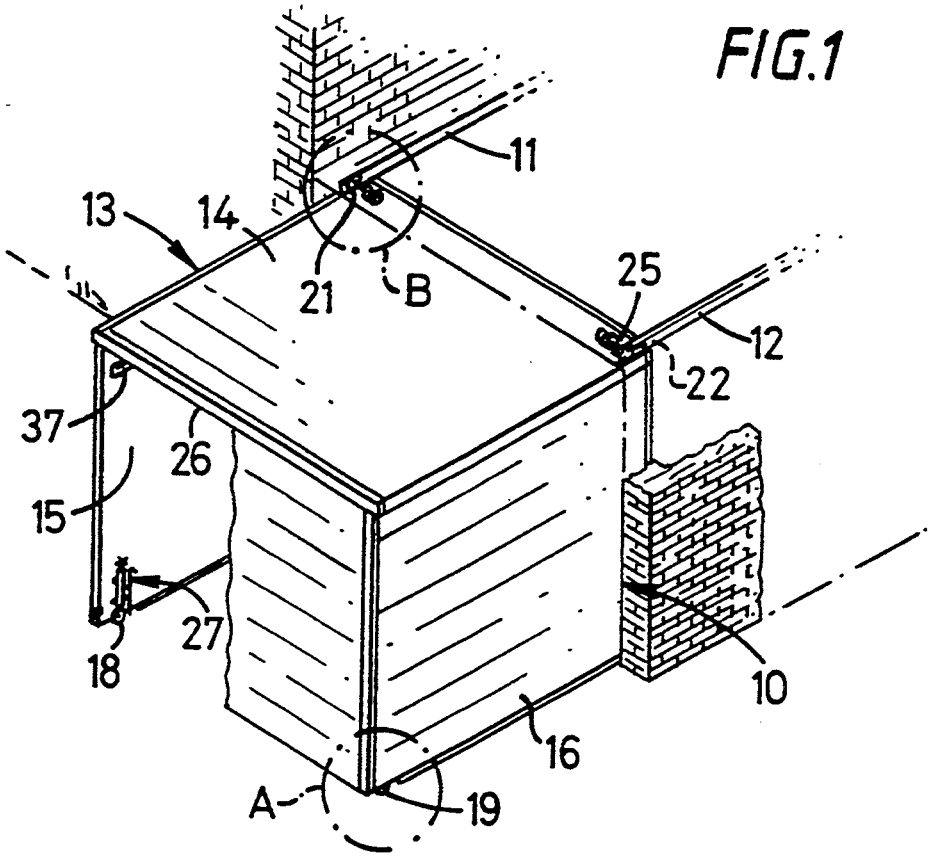
FIG. 1 is an orthogonal view of garage extension apparatus in a position to extend the interior of a garage, a portion of the front of the apparatus being broken away to show part of its interior.

FIG. 1 shows brickwork which forms an enclosure (10) in a building for use as a garage.

A channel section extrusion (11,12) is mounted generally horizontally within the enclosure (10) with its mouth facing inwardly, each of the extrusions (11,12) being mounted on a respective side wall of the enclosure (10) near the ceiling of the enclosure (10).

Figure 3:
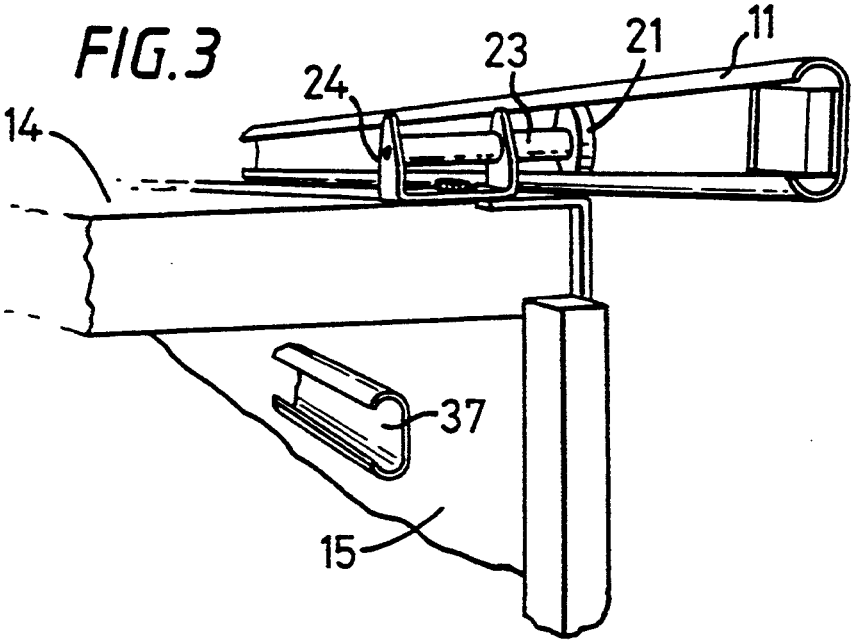
FIG. 3 is a view in perspective, from the rear of the apparatus, of the region B of the apparatus shown in FIG. 1, drawn to a larger scale than FIG. 1.

Movable structure (13), which comprises a flat roof panel (14), side walls (15,16), and an up-and-over door (17) at the front, is movable in and out of the enclosure (10), running on a pair of ground engaging wheels (18,19) which are mounted one at the foot of either side wall (15,16), near to the front of the respective side wall (15,16), and another pair of wheels (21,22) which each run in a respective one of the channels of the extrusions (11,12). FIG. 3 shows the upper wheel (21) which runs in the channel of the extrusion (11) is journaled on an axle (23) which is mounted in the arms of a U-shaped mounting bracket (24) which is mounted by its base on the top of the roof panel (14) adjacent to the rear edge thereof, the axle (23) projecting from the mounting bracket (24), beyond the adjacent side edge of the roof panel (14) and into the channel of the extrusion (11) thereby providing a pivotally mounted means between the movable structure (13) and the enclosure (10). FIG. 1 shows the other upper wheel (22) is similarly journaled on an axle (25) and it is to be understood that the axle (25) is similarly mounted on the top of the roof panel (14) adjacent the rear edge thereof, so that it projects beyond the other side edge of the roof panel (14) and into the channel of the extrusion (12).

Figure 4:
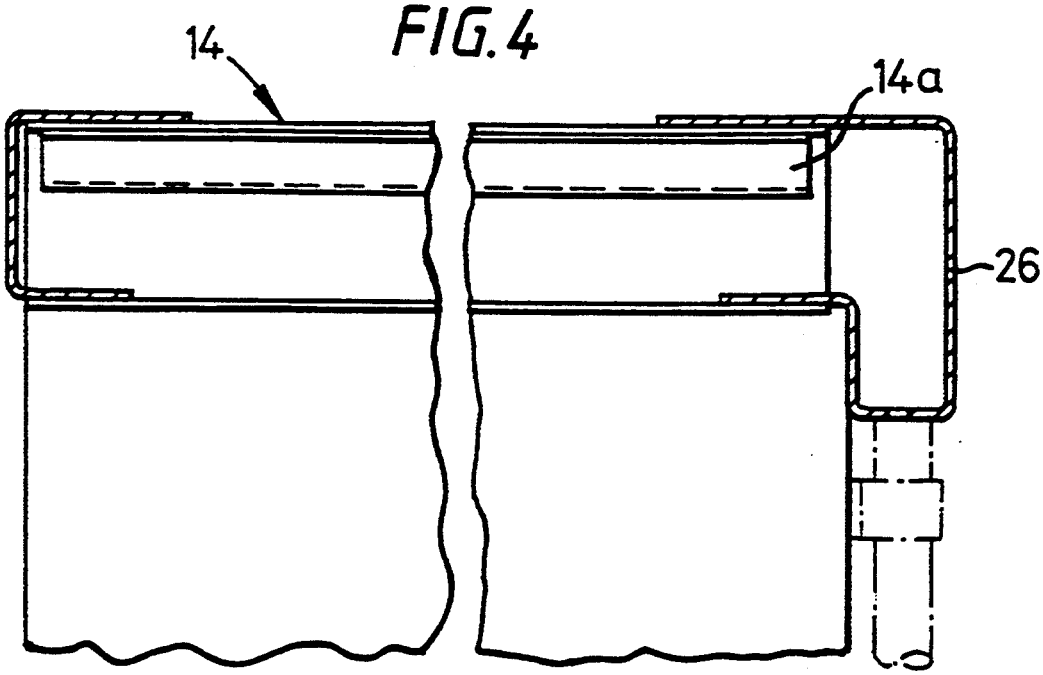
FIG. 4 is a typical cross-section of the roof panel of the apparatus shown in FIGS. 1–3 along a line extending from the front to the rear of the apparatus.

Conveniently each of the flat roof panel (14), side walls (15 and 16) and the door panel of the up-and-over door (17) are formed of similar panels which may comprise one of the panels commonly used as the door panel of an up-and-over door. A typical construction of a suitable panel comprises a generally rectangular sheet metal portion having parallel grooves found therein by swaging and running from end to end, with channel section edge strips extending along the sides and ends of the sheet metal portion. However, it is preferable for the roof panel (14) to have a;front edge portion (26) which depends below the remainder, as shown in FIG. 4, over the full width of the roof panel (14) at its front instead of the simple channel-section edge strip that is provided at the rear end and along the sides. The roof panel (14) may rest upon the side walls (15 and 16) or may bridge the gap between them at their upper edges. The depending front edge portion serves as a trough into which water collected on the roof panel (14) can fall from the open ends of the swaged grooves 14A that run from the back to the front of the roof panel 14, there being holes at the ends of the trough to allow drainage of water from the trough, say down a hollow vertical portion of the respective side wall (15,16) which serves as a side post of the door frame.

Figure 2:
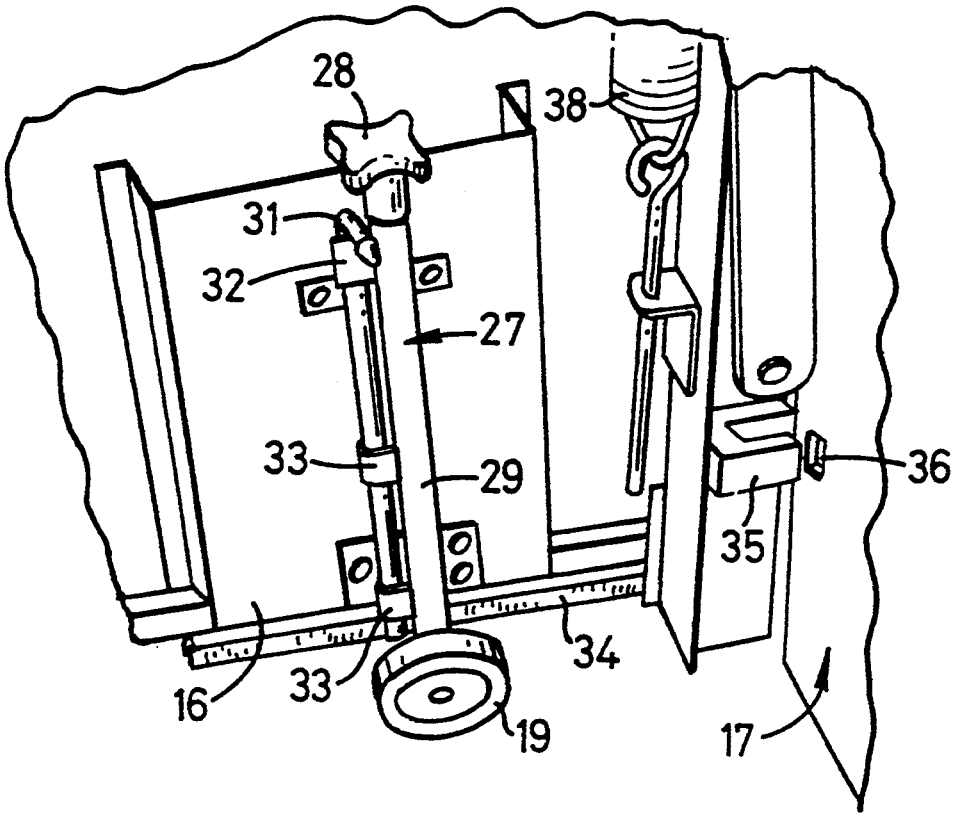
FIG. 2 is a view in perspective from within the garage extends ion apparatus of the region A of the apparatus shown in FIG. 1, drawn to a larger scale than FIG. 1 and with the front door slightly ajar.

Each ground engaging wheel (18,19) is journaled at the bottom of a respective elongate screw jack element which is engaged with a nut element formed in a body of the respective screw jack, the body being mounted on the inner surface of the respective side wall (15,16). FIG. 2 shows the ground engaging wheel (19) at the bottom of the respective screw jack (27). A cruciform handle (28) is provided at the top of the screw jack element of the screw jack (27) whereby that element can be rotated within the body (29) to raise or lower the wheel (19) relative to the respective side wall (16). A drop bolt (31) is carried by each screw jack body (29) and is adapted to engage in a corresponding hole in the ground when dropped, each body (29) having a lateral projection (32) which serves as a retaining abutment on which a hook portion at the top of the respective drop bolt (31) can be placed so that that drop bolt (31) is held above the ground, and a spaced pair of loops (33) which constrain the main portion of the respective drop bolt (31) for movement relative to the body (29), up or down.

An elongate skirt (34) of flexible material extends along and depends from the bottom of either side wall (15,16) from which it is suspended, to engage the ground as draft exclusion means. Similar strips of flexible material depend from the top, and project inwardly from the sides of the opening formed by the enclosure (10), to engage the roof portion (14) and the sidewalls (15 and 16) of the movable structure (13) that extends therethrough, for draft exclusion purposes.

The door panel of the up-and-over door (17) closes the space that is bounded by the portal frame that is formed by the side posts which comprise vertical edges of the side walls (15,16) at the front of the apparatus, and the front edge portion (26) of the roof panel (14). Each side post has a U-shaped member (35) mounted on its front face, with the limbs of that member (35) extending forwards, as can be seen in FIG. 2. The U-shaped members (35) are located so that the inner limb of each of them enters an aperture (36) formed in the rear face of the door panel as the door is closed, so that any tendency for outwards splaying of the side walls (15 and 16) is inhibited by the closed door panel due to the engagement of the two members (35) mounted on the side posts with the outer edges of the apertures in the door panel.

As an alternative to the U-shaped members (35), the door may have a pair of projections fitted to its rear surface, each such projection tapering away from the door panel and being adapted to enter a respective aperture formed in the respective part of the portal frame, one on each side of the opening that is closed by the door. Each side post of the portal frame may be fitted with flared guide means which curve inwardly into the opening to center the door within the opening and align the tapered projections with their respective apertures.

The up-and-over door mechanism fitted is of the type that has channel section guide tracks for its runner guides and they are shown (at 37) mounted on the inner surface of each side wall (15,16). Alternatively the up-and-over door mechanism may be of the cantilever type which has no such guide tracks. The usual counter-balance springs (38) are anchored to the rear faces of the side posts of the portal frame, as can be seen from FIG. 2. Of course other types of doors, such as roller doors may be used. Locking means (not shown) are mounted on the portal frame, and adapted to co-operate with corresponding keeper means formed in the permanent structure around the access opening of the enclosure (10). Alternatively a hole maybe formed in the ground within the enclosure (10) and on either side thereof, to receive a respective one of the drop bolts (31) when the movable structure (13) is within the enclosure (10), there being another pair of drop bolts carried by the side walls near the rear end thereof.

When it is desired to extend the protected internal space of the garage, the locking means carried by the movable structure (13) at the front are disengaged from the corresponding keepers in the permanent structure, or the lock bolts (31) are withdrawn from their holes within the enclosure (10). The movable structure (13) is slid from within the enclosure (10), conveniently by grasping the handle of the up-and-over door (17), which is latched closed, and pulling the movable structure (13) forward on its wheels (18,19,21 and 22), or alternatively by pushing the closed door (17) from the inside. The arrangement of the pair of ground engaging wheels (18 and 19) at the front and the pair of upper wheels (21 and 22) which are diagonally displaced from the ground engaging wheels (18 and 19), in the context of the rectangular side walls, and which are mounted at the rear of, and on the top of the movable structure (13), enables the movable structure (13) to follow the slope of the carriageway extending from the front of the enclosure (10), so as to allow the movable structure (13) to adjust its attitude relative to the horizontal with the slope of the carriageway, for its weight to be borne through those wheels (18, 19, 21 and 22) and for it to be guided for rectilinear movement by the channel section extrusions 11 and 12. Of course the degree of slope that can be followed is governed by the clearance between the roof panel (14) and the top of the opening in the enclosure or between the bottom of the sidewalls (15 and 16) and the ground at that opening, but it will be greater than could be followed if the wheels were mounted in the sidewalls of the enclosure because the movable structure must pivot about those wheels and the arc of movement must be greater in the latter case.

When the movable structure (13) has been pulled or pushed out of the enclosure (10), the drop belts (31) are dropped into corresponding holes in the ground to lock the movable structure (13) in position. Where another pair of drop belts are provided at the rear of the side walls (15 and 16), those holes that receive the drop belts 31 are so positioned relative to the holes formed in the ground within the enclosure that the latter holes can receive the other drop bolts when the drop bolts (31) are dropped into the holes outside the enclosure (10). Should the ground be uneven from side to side, either or both of the screw jacks (27) can be operated until the side posts of the portal frame at the front are truly vertical and the front portion (26) of the roof panel (14) is truly horizontal. That condition is desirable for proper operation of the up-and-over door (17). For moderate side to side slopes, it should be sufficient to operate the appropriate screw Jack (27) when the movable structure (13) has been pulled or pushed out of the enclosure, but for steeper slopes it may be necessary to operate the appropriate screw jack (27) at an interim stage during movement of the movable structure out of the enclosure.

If the enclosure (10) is sufficiently wide, say for example wide enough for a double-width up-and-over garage door to be used, a third channel section extrusion may be mounted on the ceiling of the enclosure, substantially mid-way between and parallel to the extrusions (11 and 12) and with its mouth facing in the same direction as the mouth of one of the extrusions (11 and 12) and towards the other, there being a third wheel mounted in a similar manner to the upper wheels (21 and 22) at the center of the rear of the top of the roof panel (14) to run in the channel of the third extrusion and provide additional support for the movable structure.

In a modification of the apparatus described above with reference to FIGS. 1–4 of the drawings, each upper wheel (21,22) is one of two rollers which run in the channel of the respective extrusion (11,12).

Instead of being journaled in a U-shaped mounting bracket (24), the roller that comprises the upper wheel (21,22,) is journaled on an axle which projects from the base of the channel of a channel section beam on which it is fixed, the fixing of the axle on the beam being nearer to one end of the beam than to the other, and each beam being incorporated in a respective one of the sidewalls (15 and 16). The other of the pair of rollers that runs in the respective extrusion (11,12) has an axle which is journaled in one end of an arm which is pivotally mounted at its other end on the base of the respective channel section beam adjacent the end of that beam that is nearer to the fixing of the axle on which the respective upper wheel (21,22) is journaled. The mouth of the channel of each channel section beam faces the interior of the enclosure (10) and the end of that beam at which the arm is mounted is nearer to the rear of the enclosure (10) than is the other end of that beam. By this arrangement, the channel section beam is guided for rectilinear movement into and out of the enclosure by engagement of the respective rollers within the channel of the respective extrusion (11,12). Each arm allows the attitude of the respective beam to be adjusted relative to the horizontal during such movement. The channel section beams serve as the guide tracks (37) for the runner guide means of the up-and-over door mechanism (17).

The roof panel (14) may include a section comprising a rectangular framework clad with corrugated roofing material which is pivotally mounted at its front end near to the front edge portion (26). Resilient means would be provided for urging the rear of the framework upwards relative to the remainder of the roof panel (14). Side skirt portions would depend from the sides of rectangular framework to close the space between it and the remainder of the roof panel (14) when it is in its raised position. Latching means would be provided for latching the framework within the roof panel (14) against the action of the resilient means.

A side door with one or more windows may be fitted into the side walls.

The side walls may comprise separable panels which can be added to the rear of the movable structure (13) as the latter is pulled out from the enclosure (10), and which can be removed and stowed in a convenient location within the enclosure (10) as the movable structure (13) is pushed back into the interior of enclosure (10).

I claim:

1. Apparatus for temporarily extending an enclosure comprising:

a movable structure forming a roof portion and sidewalls depending from said roof portion and a wheel adjacent the bottom of each sidewall for running on the ground as the movable structure is moved into and out of the enclosure, said movable structure being guided for substantially rectilinear movement into and out of the enclosure by interengagement of pivotally mounted means and straight guide track means, said guide track means being horizontally and statically mountable adjacent to the enclosure, and said pivotally mounted means including a fixed base being mounted on said roof portion of said movable structure at a location thereon relative to the location of said wheels such that the attitude of said movable structure is pivotally adjustable automatically relative to the horizontal and to said guide track means in response to movement of said movable structure into and out of the enclosure with the pivotally mounted means being movable parallel along said guide track means thereby enabling the movable structure to follow a carriageway having a slope in front of the enclosure.

2. Apparatus according to claim 1 in combination with said enclosure, wherein there is one such pivotally mounted means on either side of said movable structure for engagement in a respective elongate cavity formed in respective guide track means, said guide track means extending generally horizontally along each side of the enclosure.

3. Apparatus according to claim 2, wherein each straight guide track means comprises a channel section defining said elongate cavity and each pivotally mounted means comprises a wheel being journaled on an axial shaft mounted on said base and pivotally runs within a respective channel section.

4. Apparatus according to claim 1, wherein said pivotally mounted means are mounted on said roof portion adjacent one end of said movable structure.

5. Apparatus according to claim 1, in combination with said enclosure, a door carried by said movable structure at its front to close the enclosure whether the latter is extended or not.

6. Apparatus according to claim 5, wherein the door is an up and over door.

7. Apparatus according to claim 5, including a means cooperable between said door, when closed and said side walls for inhibiting outward splaying of the sidewalls.

8. Apparatus according to claim 1, wherein at least one of said wheels is movably mounted on an associated sidewall, and means operable to raise or lower said one wheel relative to said associated sidewall whereby said roof can be horizontal and the sidewalls vertical with both wheels in contact with ground which slopes from one sidewall to the other.

9. Apparatus according to claim 1 in combination with said enclosure, including vertical bolts carried by said sidewalls, respectively, each being movable for engagement within a corresponding hole formed in the ground at suitable locations to enable said movable structure to be locked in either its position stowed within the enclosure or in its position to which it is moved by drawing out of the enclosure to extend the internal space.

10. Apparatus according to claim 1, wherein said roof portion comprises a panel having a front edge and a front edge strip which extends over the front edge of the panel from side to side and forms a trough below the front edge of the panel to collect water which falls from the front of the panel and to allow it to drain to one side of the movable structure.

* * * * *